United States Patent [19]

Eliason

[11] 4,288,992

[45] Sep. 15, 1981

[54] CURTAIN FOR OPEN FRONT FREEZER OR REFRIGERATOR

[75] Inventor: Carlyle R. Eliason, 905 W. Inkster, Kalamazoo, Mich. 49008

[73] Assignee: Eliason Corporation, Kalamazoo, Mich.

[21] Appl. No.: 122,647

[22] Filed: Feb. 19, 1980

[51] Int. Cl.[3] ..... A47F 3/04; F25D 23/02

[52] U.S. Cl. ..... 62/256; 62/265; 312/116

[58] Field of Search ..... 62/255, 256, 265; 312/116; 160/184, 99

[56] References Cited

U.S. PATENT DOCUMENTS

| | | | |
|---|---|---|---|
| 2,041,258 | 5/1936 | Mitchell | 62/265 X |
| 3,186,185 | 6/1965 | Bently et al. | 62/255 |
| 3,241,899 | 3/1966 | Donker | 62/255 X |
| 3,403,525 | 10/1968 | Beckwith et al. | 62/256 X |
| 3,542,445 | 11/1970 | Donker | 312/116 |
| 4,109,484 | 8/1978 | Cunningham | 62/256 |
| 4,117,698 | 10/1978 | Vogel | 62/256 |
| 4,186,790 | 2/1980 | Schenker et al. | 312/116 X |

FOREIGN PATENT DOCUMENTS

| | | |
|---|---|---|
| 1302247 | 10/1961 | France . |
| 54-175662 | 12/1979 | Japan . |
| 55-16749 | 2/1980 | Japan . |

*Primary Examiner*—Lloyd L. King

*Attorney, Agent, or Firm*—Blanchard, Flynn, Thiel, Boutell & Tanis

[57] ABSTRACT

Curtain structure for substantially covering the access opening of an open-sided, display-type, refrigerated food cabinet. A first curtain comprises a flexible sheet prestressed to roll up and fixed at its upper edge to the ceiling of the cabinet inboard of the access opening. The first curtain may be unrolled and its bottom edge attached to the floor of the cabinet to substantially block air movement into and out of the cabinet. A second curtain comprises a plurality of side-by-side, elongate strips of flexible transparent sheet material, fixed together at their upper ends and supported on the cabinet at the top of the access opening. The lower ends of the strips are free of each other and terminate slightly above the bottom of the access opening. The second curtain is spaced away from the closed position of the first curtain by an air layer providing a thermal barrier across the access opening when access to the interior of the cabinet is not needed. With the first curtain rolled up, the second curtain obstructs air movement into and out of the cabinet but permits visual and physical access to the interior of the cabinet through the access opening. The curtain structure is particularly adaptable to use with refrigerated cabinets having an air curtain across the access opening, with the first curtain interposed between the second curtain and air curtain.

17 Claims, 16 Drawing Figures

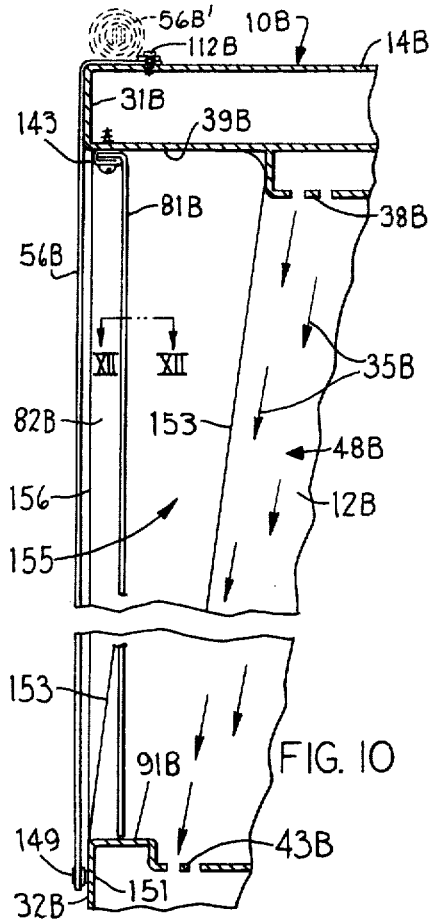
FIG. 10
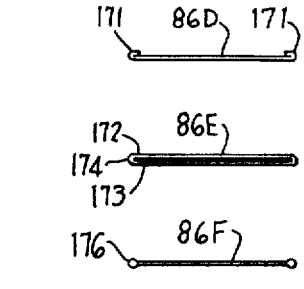
FIG. 12
FIG. 13
FIG. 14
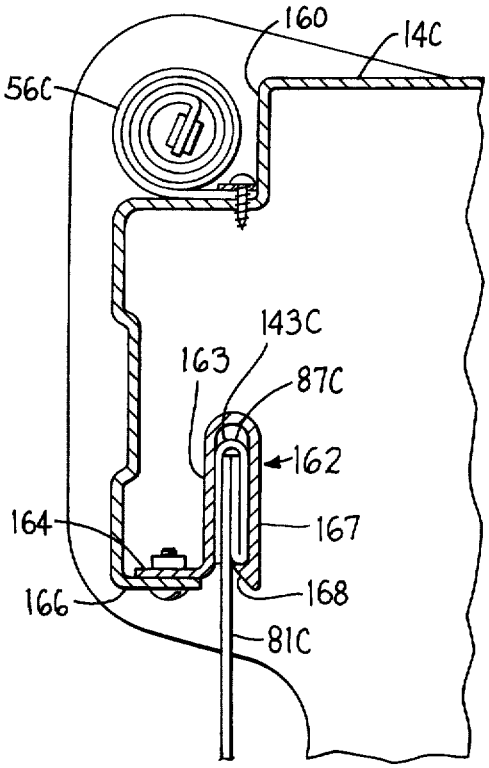
FIG. 11
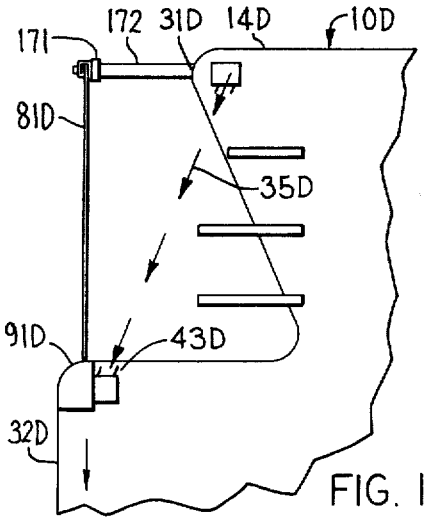
FIG. 15
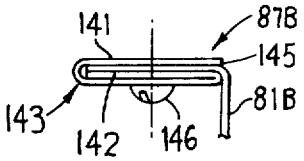
FIG. 10A

CURTAIN FOR OPEN FRONT FREEZER OR REFRIGERATOR

FIELD OF THE INVENTION

This invention relates in general to curtain structure for covering the access opening of a display-type refrigerated food cabinet.

BACKGROUND OF THE INVENTION

Display-type refrigerated cases, of the type having an open side, have for many years been used in retail stores to visually display and permit unimpeded removal of food items while maintaining such food items refrigerated. Such refrigerated open-sided cases are frequently used for food items which must be kept chilled to well below ambient temperature and, in some instances, are to maintain food items below freezing. It will be understood, therefore, in the following discussion that reference to refrigerated cases or cabinets will include both freezer- and nonfreezer-type refrigerating units.

Such open-sided refrigerating cabinets are a convenience to the shopper since they avoid the effort and time loss in opening and closing the usual swinging or sliding doors on conventional closed refrigerated display cabinets. However, open-sided cabinets of the aforementioned type have a long-standing problem in that they rather freely permit large amounts of refrigerated air to "spill out" therefrom. This is undesirable in several respects.

First, energy loss resulting from the spill of cold air from the cabinet and its consequent replacement with warm ambient air necessitates a much larger and more costly refrigerating system than would be required for a completely enclosed refrigerated cabinet of comparable cubic space. The compressor motor for such an open-front cabinet may have to be several times more powerful than the corresponding motor for an enclosed cabinet. Accordingly, the cooling system parts for the open-sided cabinet must be larger and hence more costly, both in terms of initial cost and maintenance cost.

Second, cold air spilled from the open-sided refrigerating cabinet in most instances represents a net energy loss in terms of electricity wasted in unnecessary running of the refrigeration machinery thereof. Such cold air spill may, particularly in cold weather, result in a further indirect energy loss in terms of extra fuel required for extra running of the store's furnace to maintain a desired ambient temperature in the store despite the spilled cold air. This energy waste may be regarded as socially undesirable in times of scarce energy supplies and, in any event, represents an extra overhead cost for the store operator, increasing as energy prices rise.

Further, the spill-out of refrigerated air, particularly in large food markets where several refrigerated cabinets including freezers may be located in the same part of the market, creates cold floor conditions near the freezers, which is uncomfortable for customers and personnel and may upset the equilibrium of the thermostats controlling the store's heating and cooling system, resulting in difficulty in maintaining the desired temperature in the rest of the store.

Further, the continuing unrestricted exchange of cooled air spilling from the refrigerated cabinet and warmer ambient air spilling into the cabinet, through the open side thereof, requires more frequent defrosting, and more frequently subjects the stored food to quality degradation due to the warmer temperatures within the cabinet during a defrost cycle.

In partial solution of these problems, U.S. Pat. Nos. 3,241,899 and 3,542,445 (Donker) and U.S. Pat. No. 3,186,185 (Bently) provide a curtain in the form of a flexible roll-up sheet mounted on a refrigerated cabinet adjacent the access opening thereof. When customer access to contents of the cabinet is not required, as when the store is closed, such sheet can be unrolled to cover the access opening and thereby substantially reduce the amount of cool air spilling out of the cabinet through the access opening. In the case of a very wide cabinet, several such sheets may be used in side-by-side relation.

However, when customer access to the contents of the cabinet is required, as when the store is open, for example during the day, such flexible sheet curtain is rolled up leaving the access opening of the cabinet entirely open, as if no curtain were installed. Accordingly, such a roll-up sheet curtain does not solve the foregoing problems when the store is open for business.

It is also known from U.S. Pat. No. 2,041,258 (Mitchell) to provide a conventional, apparently domestic refrigerator with an air-dam curtain of "cellophane" strips, fixed across the access opening of the refrigerator inboard of the hinged door thereof. The upper and lower ends of each cellophane strip are secured by an adhesive strip to an elastic insert, which elastic insert is in turn secured to a transversely extending flexible strip. An adhesive surface on each of the transversely extending strips secures the elastic inserts thereto and permits securement thereof to the top and bottom interior surfaces of the refrigerator closely behind the refrigerator door. Unfortunately, this particular air-dam construction is complicated by the need for elastic material at the end of each cellophane strip and limits access to the refrigerator contents because both ends of the strips are secured, although resiliently, to the corresponding top and bottom walls of the refrigerator cavity. Moreover, the cellophane air-dam is normally hidden behind the door and functions only during those relatively brief and infrequent intervals during which the householder swings open the door to insert or remove a food item. The structure of this prior patent is apparently not intended for and is not a suitable substitute for a commercial open-sided refrigerated food cabinet for grocery stores and the like, to which the present invention is directed.

Accordingly, the objects of this invention include provision of:

A curtain structure for the access opening of a side-opening, display-type, refrigerated food cabinet capable of obstructing air flow into and out of the cabinet, without significantly impeding visibility of food products within the refrigerated cabinet and without significantly impeding physical access to and removal of such food products from the refrigerated cabinet, when in condition for customer access, as during normal business hours of a store or the like.

A curtain structure, as aforesaid, which during hours in which the store is closed and customer access to the interior of the cabinet is not required, provides for interposition of a pair of substantially fully overlapped curtains substantially closing the access opening of the cabinet to doubly impede airflow into and out of such cabinet and wherein said curtains are spaced to provide an air layer acting as a thermal barrier to additionally reduce transfer of heat into the cabinet.

A curtain structure, as aforesaid, constructable of commonly available, lightweight, inexpensive, sheet material, which curtain structure is readily installable on new open-sided refrigerating cabinets during manufacture as well as being readily installable in the field on existing, in-use, side-opening refrigerator cabinets.

Other objects and purposes will be apparent to persons acquainted with apparatus of this general type upon reading the following specification and inspection of the accompanying drawings.

SUMMARY OF THE INVENTION

The objects and purposes of the invention are met by providing curtain structure for a display-type refrigerated food cabinet having an access opening communicating with the atmosphere. A barrier, here in the form of a curtain comprising a flexible sheet capable of being rolled up on itself, is unrollable to substantially cover said access opening. A second curtain comprises a plurality of side-by-side elongate strips of flexible transparent sheet material, fixed together at their upper ends but not at their lower ends. Means are provided for attaching the upper ends of the strips in common to the cabinet along and substantially parallel to the upper edge of the access opening with the strips depending across the access opening outboard of the barrier. The strips normally cover the access opening from the top thereof substantially to the bottom to obstruct air movement between the inside and outside of the cabinet while permitting visual inspection and physical access to the contents of the cabinet. The two curtains in their closed positions are spaced from each other and provide an air layer therebetween substantially spanning the access opening and acting as a thermal barrier thereacross.

BRIEF DESCRIPTION OF THE DRAWINGS

FIG. 10 is a view generally similar to FIG. 4 but showing modified curtain mountings.

FIG. 10A is an enlarged fragment of FIG. 10.

FIG. 11 is an enlarged side cross-sectional view showing further modified curtain mountings.

FIG. 12 is an enlarged cross-sectional view of a curtain strip substantially as taken on the line XII—XII of FIG. 10.

FIG. 13 is a view similar to FIG. 12 but showing a modification.

FIG. 14 is a view similar to FIG. 12 but showing a further modification.

FIG. 15 is a fragmentary view similar to FIG. 3 but showing a further modified cabinet and strip curtain structure.

DETAILED DESCRIPTION

Figure 1:
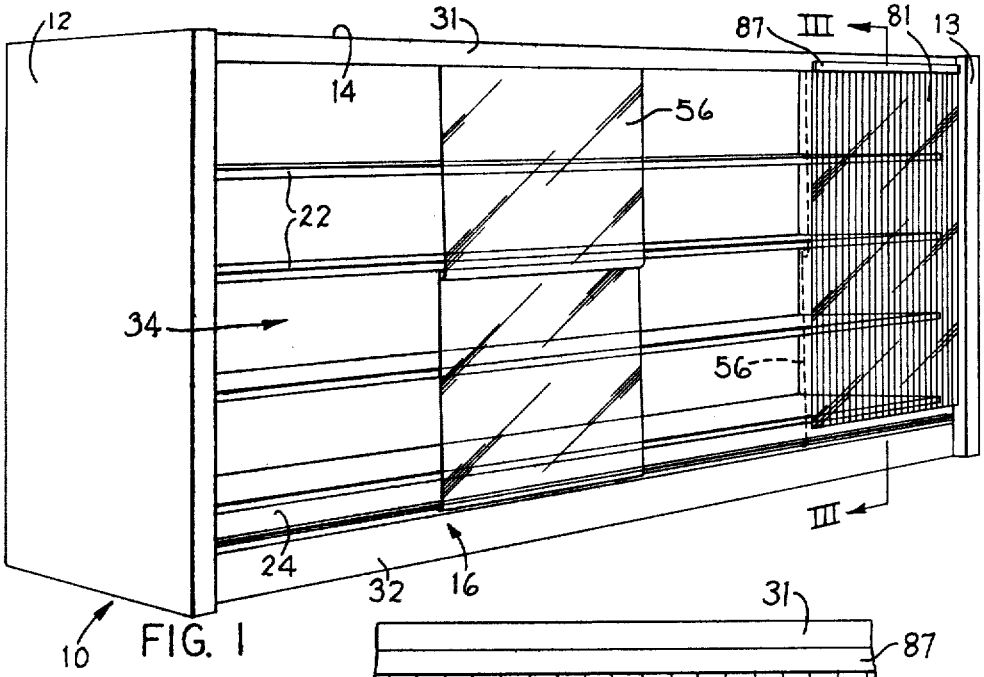
FIG. 1 is an oblique view of a side opening, display-type, refrigerated food cabinet, including a curtain structure and embodying the invention.
Figure 3:
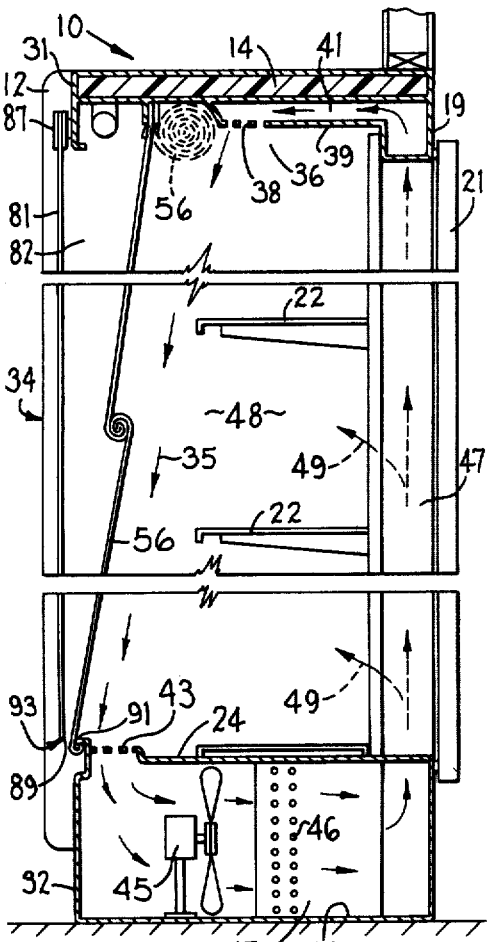
FIG. 3 is an enlarged, side, cross-sectional view substantially taken on the line III—III of FIG. 1.

FIGS. 1 and 3 disclose a conventional open-sided, display-type, refrigerated food cabinet 10 having upstanding side walls 12 and 13, a top wall 14 connecting the tops of the side walls and a bottom compartment 16 housing a conventional refrigeration unit schematically indicated at 17. In the particular embodiment shown, the back wall 19 of the cabinet 10 is provided with one or more access doors 21 which open to the rear for stocking of the cabinet. Shelves 22, here fixed on the back wall 19 of the cabinet, support food articles within the cabinet. Additional food articles may be supported on the cabinet floor 24, which overlies the compartment 16. The front wall of the cabinet 10 has upstanding upper and lower portios 31 and 32 and is open therebetween to provide an access opening generally indicated at 34.

An air curtain unit 36 may be provided for generating a substantially planar air curtain indicated by arrows 35. The unit 35 here includes a refrigerated air outlet grill 38 extending the width of the cabinet 10 at a location spaced behind the access opening 34. The outlet grill 38 in the embodiment shown in FIG. 3 is conventionally provided in a false ceiling 39 spaced below the top wall 14 to define an air flow space 41 therebetween.

The air curtain unit 36 further includes an air return grill 43 which extends the width of the cabinet behind the access opening 34 and opens to the bottom compartment 16. The air curtain unit 36 preferably includes coventional air cooling and circulating means schematically shown in FIG. 3 to include a motor driven fan 45 disposed in the bottom compartment 16 of the cabinet to pull air through the grill 43 and pass same over refrigerated coils 46 of the refrigerating unit 17. Such refrigerated air then passes rearwardly and up through passages (not shown) in the cabinet back wall 19 (as indicated by the dotted line arrows 47), forwardly through the upper air flow space 41, out the outlet grill 38, and then down along and immediately in front of the front edges of the shelves 22 to return through the air return grill 43. The cabinet ducting leading refrigerating air from the refrigerated coils 46 in the direction of the arrows 47 conventionally include outlets therefrom into the food storage area 48 of the cabinet, as schematically indicated by further broken line arrows 49.

To the extent above described, the refrigerated cabinet 10 is conventional and it will be understood that the particular cabinet 10 disclosed is but one example of open-sided, display-type, refrigerated food cabinets to which the present invention is applicable. For example, the present invention is applicable to free-standing as well as built-in refrigerated cabinets. Also, while the present invention is advantageously applied to cabinets having an air curtain, the invention is also applicable to cabinets without an air curtain.

As seen in FIGS. 1 and 3, a curtain 56 in the form of a flexible sheet is supported in the cabinet 10 between the air curtain unit 36 and access opening 34. The curtain 56 is deployable to form a barrier across the access opening 34, as seen in solid lines in FIGS. 1 and 3, and thereby to obstruct air movement between the inside and outside of the cabinet 10. The curtain 56 may extend the full width of the access opening 34, or in the case of relatively wide cabinets, as seen in FIG. 1, a plurality of sheets 56 may be provided in side-by-side relation across the access opening 34 to obstruct air movement over the entire width of the access opening 34. When several sheets 56 are thus provided, it is simplest to support same in edge abutting relation, though it is also contemplated to so mount the adjacent sheets 56 as to permit slight overlapping of their adjacent side edges.

While the sheet 56 may be mounted inside one side wall 12 or 13 of the cabinet 10 to extend horizontally thereacross in its closed position, it is preferred to extend and retract the sheet 56 vertically and so to mount same either adjacent the upper or lower edge of the access opening 34. In the preferred embodiment shown, the sheet 56 is mounted at its upper edge beneath the top wall 14 on a suitable bracket as hereafter discussed and has a lower edge arranged to releasably connect to the bottom portion of the cabinet outboard of the return grill 43, as hereafter discussed.

The sheet 56 is retractable to permit customer access, both visually and to remove food articles from the shelves 22. The retracted position of the sheet 56 is shown in dotted lines at 56' in FIG. 3 at the upper end of the cabinet.

While the invention in its broader aspects is not so limited, the sheet 56 of FIG. 3 is preferably a sheet material curtain of one of the types disclosed in aforementioned U.S. Pat. Nos. 3,241,899 and 3,542,445, the disclosures of which are incorporated herein by reference. Accordingly, the sheet 56 is preferably of a resiliently flexible material, such as the plastic material known by the tradename "Mylar", which is capable of being prestressed with a substantially permanent curvature of small radius and having a relatively long duration memory. More particularly, the sheet material of curtain 56 may be curved, as generally indicated in broken lines in FIGS. 3 and 4 and in solid lines in FIG. 5, to remain in a tight roll capable of supporting its own weight, even though suspended by a free outer edge and even though repeatedly unrolled, as indicated in solid lines in FIGS. 3 and 4 and broken lines in FIG. 5, and left in such unrolled position for relatively long periods of time, for example several days or more. Moreover, it has been suggested in the aforementioned patents that a plurality of relatively widely spaced and relatively small openings (now shown here) may be provided through the sheet 56, through which small amounts of air can move when such sheet is in its unrolled, extended position. Such holes have been useful in avoiding build-up of condensation and frost on the back side of the sheet, thereby avoiding interference with rolling up of the sheet 56 as might result from a frost layer.

Figure 4:
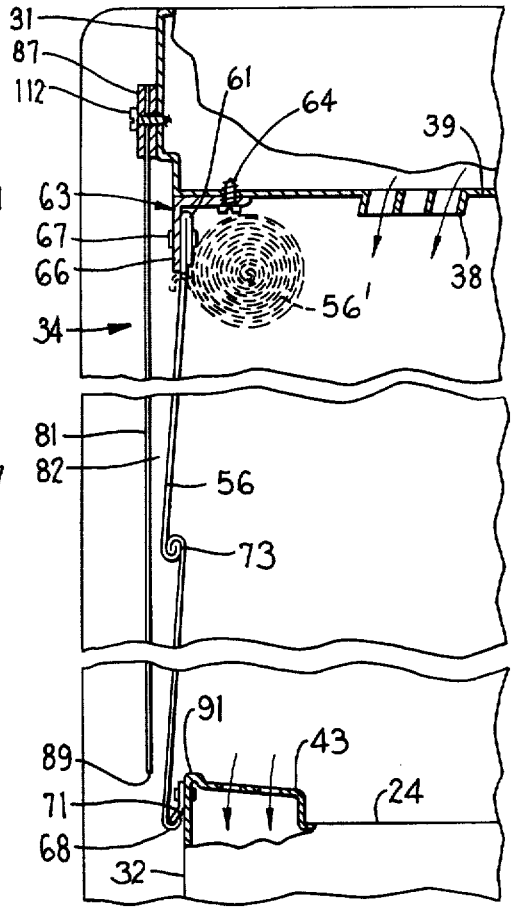
FIG. 4 is an enlarged fragmentary view generally similar to FIG. 3 and showing a curtain structure in accord with the present invention.

In FIG. 4, the sheet 56 includes an upper edge portion 61 folded over on itself to provide a reinforced hem. In the preferred embodiment shown, an angle bracket 63 has one leg fixed to the underside of the cabinet ceiling 39, as by screws 64, with another leg 66 depending from the forward edge thereof and facing toward the access opening 34. The folded upper edge portion 61 of the sheet 56 is fixed to the depending leg 66, preferably on the rear face thereof, by any convenient fasteners, such as bolts 67. If desired, washers and/or a backing strip may be held to the backside of the edge portion 61 by the bolt 67 to reinforce the connection of the sheet 56 to the bracket 63. To hold the curtain 56 in its unrolled condition shown in solid lines in FIG. 4, the lower end of the sheet is releasably secured to the cabinet at the bottom of the access opening 34. This may be accomplished simply by providing a hooked lower edge portion 68 on the sheet 56 to hook under a suitable lip 71, or the like, fixed to the upper edge of the cabinet lower front wall portion 32, immediately in front of the air return grill 43. The particular curtain 56 shown in FIG. 4 is folded upon itself along its midline 73, the memory of the material being such that upon release of the hook 68 from the lip 71, the sheet 56 will roll itself about the axis of the midline portion 73, to assume the rolled condition shown in dotted lines at 56' immediately behind the bracket 63 and below the ceiling 39, and hence leaving the access opening 34 substantially fully open.

Figure 5:
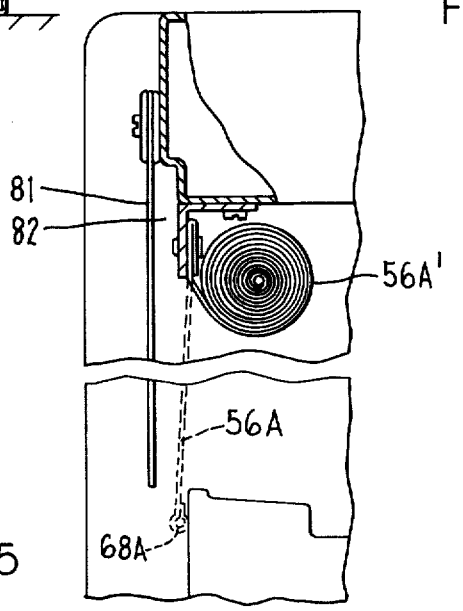
FIG. 5 is a view similar to FIG. 4 but showing a roll-up curtain of different type.

The sheet 56A of FIG. 5 differs from sheet 56 of FIG. 4 in that it is prestressed to roll, not about its midline, but rather about its lower edge hook 68A. The mounting of the upper edge portion of the sheet 56A, its rolled, stowed position (shown in solid lines at 56A') and its provision for securement in closed position (shown in broken lines at 56A and 68A) may otherwise be similar to the arrangement above discussed with respect to FIG. 4, and hence need no further description.

Figure 2:
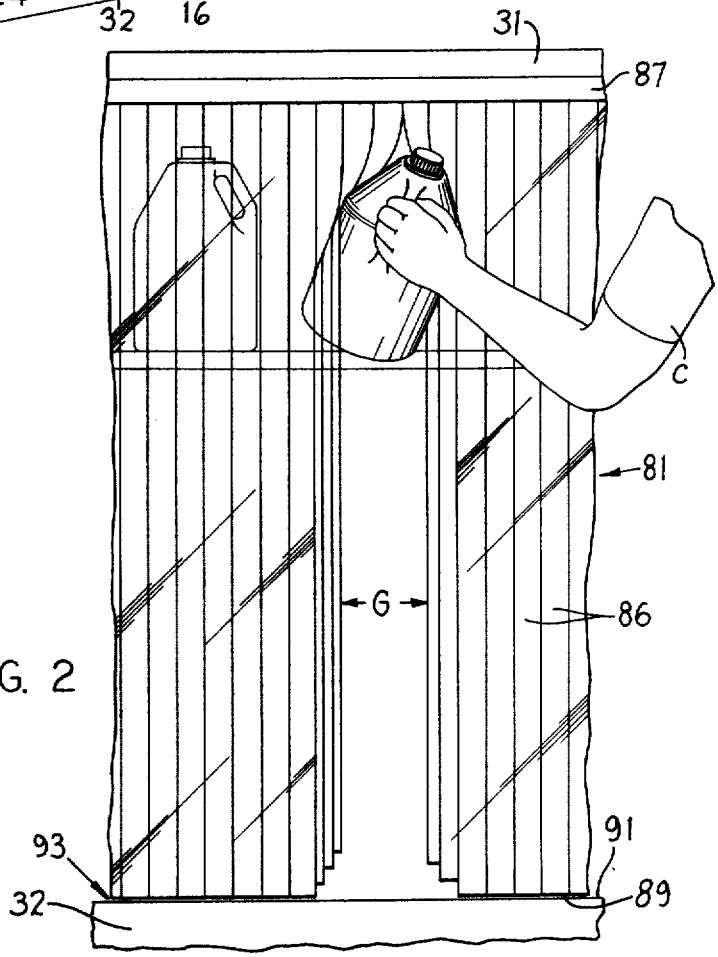
FIG. 2 is an enlarged front view of a segment of the cabinet of FIG. 1 showing a customer removing a refrigerated article from the cabinet through a portion of the curtain structure thereof.

In accord with the present invention, a further curtain 81 (FIGS. 1, 2 and 3) is pendently supported in spaced relation in front of the sheet 56 to create an air layer 82 therebetween when the sheet 56 is in its extended, or unrolled, position shown in solid lines in FIG. 3. The curtain 81 comprises a plurality of side-by-side elongate strips 86 (FIG. 2) of flexible transparent sheet material fixed together at their upper ends by a common transversely extending header structure 87. The header structure 87 is fixed to the cabinet 10 above the access opening 34. The header structure 87, being spaced ahead of the upper end of the sheet 56, may conveniently be secured to the upper portion 31 of the cabinet front wall.

The strip curtain 81 may extend the full width of the access opening 34 of the cabinet 10. However, where the cabinet 10 is of substantial width, several strip curtains 81 may be arranged in side edge-by-side edge, substantially coplanar relation along the front of the cabinet to cover substantially the entire width of the access opening 34.

While the width and material of the strips 86 may vary somewhat, in the preferred embodiment shown, the strips were each about one inch wide and constructed of a transparent plastic material (for example a clear polyester resin material, such as that marketed under the tradename "Mylar") and of about 7.5 mil (0.0075 inch) thickness.

The lower ends of the strips 86 are not connected to each other and indeed are free to move freely with respect to each other, to permit physical access to the interior of the cabinet 10 and to permit withdrawal of food items from the interior of the cabinet through the curtain 81. Thus, in FIG. 2, a customer C is seen to be withdrawing an article A, here a milk jug, from the cabinet. The article A parts its own gap G between adjacent strips 86, such that the strips 86 bordering the gap G overlap to provide a gap width in excess of several strip widths and sufficient to permit passage therethrough of even a relatively bulky article A.

In the preferred embodiment shown, the lower edge 89 of the strip curtain 81 is slightly above the upper edge 91 of the front wall portion 32 (FIGS. 2-4) to provide a horizontal extending gap 93 therebetween. The gap 93 is preferably not more than about one inch in height. Such gap is particularly desirable when the strip curtain 81 is used in combination with an air curtain unit 36. More particularly, spacing of the strip curtain bottom edge 89 above the air return grill 43 prevents the lower ends of the strips 86 from being displaced or sucked into the air return grill. This avoids possible damage to the strips and/or air curtain machinery, particularly if the fan 45 is close to the air return grill 43. This also avoids leaving a gap in the strip curtain because the lower ends of some strips remain caught in the air return grill after a customer has removed an article from the cabinet. The spacing of the strip bottom ends 89 above the cabinet wall edge 91 also permits the strips to remain hanging vertically while permitting a modest make-up flow of ambient air from outside the cabinet through the gap between the strip ends 89 and cabinet wall edge 91 into the return air grill 43, if needed to make up for possible relatively slight losses of chilled air from the upper and midportions of the air curtain and the food storage area 48 between the adjacent edges of the strip curtain. In this way, the strip curtain 81 tends to hang in stable, unmoving fashion with its vertical strips lying immediately adjacent each other to minimize loss of chilled air from the cabinet over the substantial vertical length of the strip curtain. Recognizing that some relatively slight loss of chilled air may occur through the strip curtain 81, between the strips thereof, the small gap 93 between the bottom strip ends 89 and wall edge 91 permits a sufficient and relatively modest make-up air inflow to the cabinet, without agitating the strips 86 in a manner to produce lateral gaps therebetween and thereby increase the air exchange between the cabinet and surrounding room.

Figure 6:
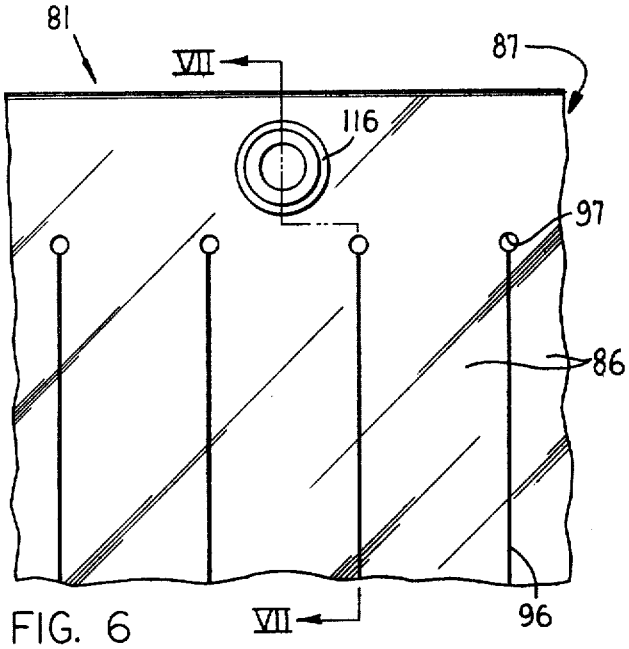
FIG. 6 is an enlarged front view of a portion of the top of a strip curtain of a type usable in the apparatus of FIGS. 1-5.
Figure 7:
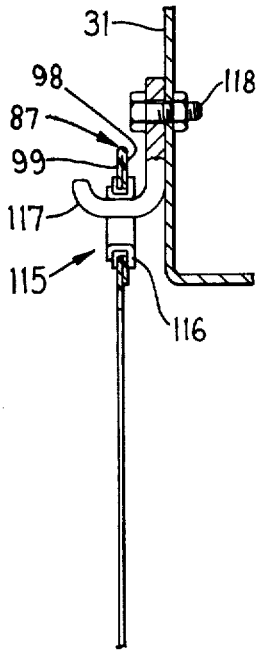
FIG. 7 is a fragmentary sectional view substantially taken on the line VII—VII of FIG. 6 and showing support of the curtain on a hook carried by the cabinet.

FIGS. 6 and 7 disclose a preferred header structure 87. In the embodiment of FIGS. 6 and 7, the strip curtain 81 comprises a unitary sheet having a continuous upper edge portion extending the full width of the sheet and defining the header structure 87. Vertical slits 96 extend from the header structure 87 through the bottom edge 89 of the sheet to separate the portion of the sheet below the header structure into the individual, side-by-side strips 86. To prevent tearing of the sheet material, enlarged circular holes 97 form the upper end of each slit 96. In the preferred embodiment shown, the upper edge portion of the sheet material is folded over upon itself, as seen at 98 and 99 in FIG. 7, with adhesive material (not shown) sandwiched between folded-over parts 98 and 99 of the sheet. If desired, the folded-over portion 98 can be eliminated and, if extra strengthening of the upper edge portion of the sheet is desired, a substantially rigid plastic reinforcing strip can be fixed to the upper edge portion 99 of the sheet, as with a pressure sensitive adhesive material. Alternately, two such substantially rigid plastic reinforcing strips may be adhesively bonded to opposite sides of the upper portion 99 of the sheet.

Figure 8:
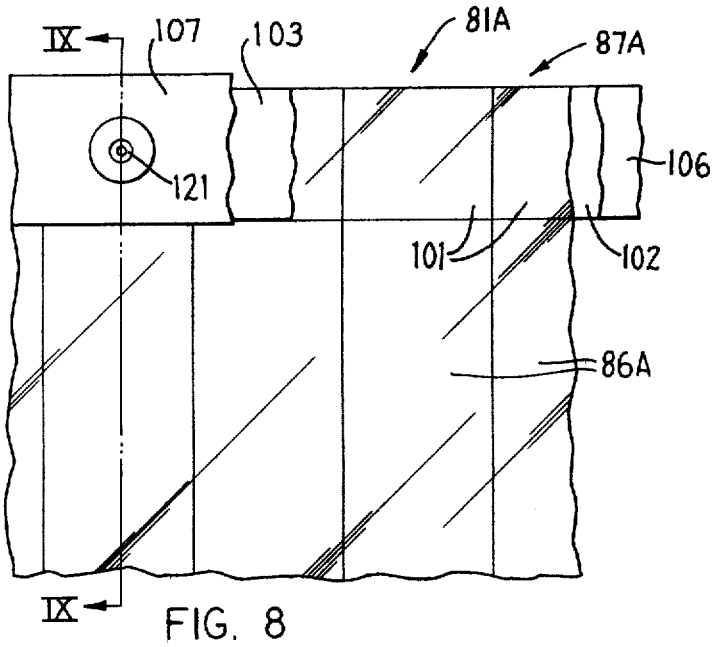
FIG. 8 is a partially broken fragmentary view similar to FIG. 6 but showing a modified strip curtain.
Figure 9:
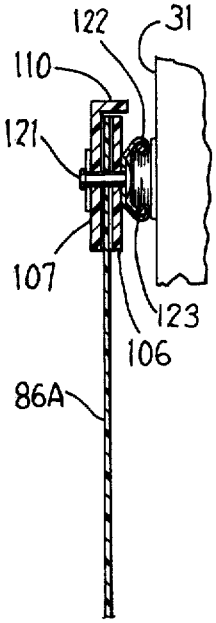
FIG. 9 is a fragmentary sectional view substantially taken on the line IX—IX of FIG. 8 and showing a mounting snap structure on the cabinet.

FIGS. 8 and 9 disclose a modified header structure 87A for a strip curtain 81A. The strip curtain 81A comprises a plurality of separate vertical strips 86A of rectangular shape placed in side edge abutting relation. The upper end portions 101 are sandwiched between a pair of pressure sensitive adhesive layers 102 and 103, the layers 101-103 in turn being sandwiched between a pair of substantially rigid plastic strips 106 and 107 to form the header structure 87A. Preferably, the upper edge of one of the semi-rigid strips 106 and 107, here the front strip 107, is provided with a horizontal flange 110 (FIG. 9) which overlies the strip end portions 101 and preferably also overlies the upper edge of the remaining substantially rigid strip 106 to form an abutment against which the strip end portions 101 and the substantially rigid strip 106 can abut to insure proper alignment of the parts during assembly of the header structure. If desired, each of the adhesive layers 102 and 103 can be a conventional double-faced adhesive tape.

The header structure 87 (or 87A) of the strip curtain 81 (or 81A) is conveniently fixed to the cabinet on the upper portion 31 of the front wall of the cabinet as shown in the accompanying drawings. However, if desired, the header structure 87 can instead be secured to a suitable surface or bracket inboard of the front wall portion 31 and beneath the top wall 14, provided that space is left between the curtains 81 and 56. The header structure 87 may be secured to the cabinet as by adhesive bonding, or by a series of screws 112 (FIG. 4) distributed laterally therealong.

FIGS. 6 and 7 disclose a removable attachment system 115 in which conventional grommets 116 are distributed along the width of the header structure 87 and are engageable with hooks 117 fixed as by bolts 118 to the front wall portion 31 of the cabinet.

Alternately, and as seen in FIGS. 8 and 9, the header structure 87A of the strip curtain may have conventional snap fasteners 122 fixed thereto, as by rivets 121, with complementary snap fasteners 123 fixed to the cabinet walls 31. The complementary snap fasteners 122 and 123 are correspondingly spaced laterally along the strip curtain and cabinet. The snap fasteners 123 may be secured to the cabinet wall 31 by any conventional means, such as screws or rivets.

OPERATION

The operation of the above-described apparatus will be largely apparent from the foregoing description, but is summarized below for convenient reference.

Operation of the refrigeration unit 17 to chill the food storage area 48 of a refrigerated, open-sided display cabinet 10 installed in a store, normally includes operation of the air curtain unit 36, if provided. When access to the interior of the cabinet 10 is not required, the sheet curtain 56 is normally closed, as shown in solid lines in FIGS. 3 and 4, to positively block air flow into and out of the cabinet. The strip curtain 81 provides a secondary barrier to air flow. The air layer 82 between the overlapping curtains 56 and 81 acts as a thermal barrier insulating the chilled interior 48 of the cabinet from the warmer air surrounding the cabinet. The closed curtains 81 and 56 substantially reduce energy loss when customer access through the access opening 34 is not required, as when the store is closed.

On the other hand, when the store is open and customer access to the cabinet 10 is required, release of the lower end 68 (or 68A) of the sheet curtain 56 (or 56A) from the lip 71 at the lower edge of the access opening permits the sheet 56 to roll up to its open position 56' (or 56A'). In its open position, the sheet curtain 56 does not interfere, either visually or physically, with customer inspection, or removal, of articles A from the cabinet 10 through the access opening. Either with or without an air curtain, the strip curtain 81 in its normal planar condition of FIGS. 1 and 3-9 substantially reduces air exchange between the inside and outside of the cabinet. The slight horizontal clearance at the bottom of the strip curtain 81 prevents entanglement of the strips 81 in the air curtain air return grill 43 and permits a minor input of make-up air, if needed, from the room into the air curtain return grill 43.

MODIFICATIONS

FIG. 10 shows a further conventional refrigerated cabinet 10B, having an air curtain 35B between air outlet and return grills 38B and 43B.

In this embodiment, the extended sheet material curtain 56B is spaced in front of, rather than behind, the strip curtain 81B and air layer 82B. The strip curtain 81B is fixed beneath the false ceiling 39B of cabinet 10B and is closely spaced above the upper edge portion 91B of the cabinet front wall portion 32B. The upper edge of strip curtain 81B is secured to the false ceiling 39B by any convenient means.

Preferably, the upper edge of strip curtain 81B has a header structure 87B (FIG. 10A) in which the upper edge of the plastic strip material (common to several strips as in FIG. 6 or made up of separate upper strip ends as in FIG. 8) is secured between the upper and middle layers 141 and 142 of a horizontally elongate, twice-folded sheet metal reinforcing member 143. An adhesive layer 145, for example, a horizontal strip of double-faced adhesive tape lies between the upper edge portion of the strip curtain 81B and an opposed portion 141 or 142 of the reinforcing member 143 to fix same together. In the embodiment shown, the reinforcing member 143 faces the underside of false cabinet ceiling 39B and is secured thereto by spaced sheet metal screws 146.

The upper end of the sheet material curtain 56B is anchored, as by screws 112B, atop the cabinet top wall 14B near the front edge portion 31B. The rolled-up sheet curtain, as shown in broken lines at 56B', is entirely retracted above the front wall of the cabinet. The curtain 56B in its rolled down full-line position at 56B covers the front of the food storage area 48B. A plurality of conventional snap fasteners spaced along the lower edge of the sheet curtain 56B coact with corresponding snap fasteners 151 on the lower front wall portion 32B of the cabinet to hold the sheet curtain 56B closed.

The cabinet 10B shown in FIG. 10 is of a widely used conventional type in which the front edges 153 of the side walls 12B are at least partly offset behind the cabinet front wall portions 31B and 32B. The resulting open areas 155 at the ends of the cabinet may be closed by covering with sheet material 156, such as flexible or rigid plastic sheeting. However, many refrigerated display cabinets in large supermarkets are of great length, for example twenty to thirty feet or more. The open end areas 155 are thus very small compared to the open front area of such cabinet. Accordingly, addition of the curtains 81B and 56B to cover the front opening of such cabinet very substantially reduces heat transfer between the cabinet and room even with the small end areas 155 left open, though it is preferred to close such end areas.

FIG. 11 discloses an embodiment generally similar to that of FIG. 10 but differing in the mounting of the curtains 56C and 81C. The sheet curtain 56C is recessed in a step 160 in the upper front edge of the cabinet.

The strip curtain 81C preferably has a header structure 87C like that shown at 87B in FIG. 10A and includes a similar reinforcing member 143C. However, the header structure 87C of the strip curtain is supported on a portion of the top wall structure 14C by horizontally spaced clips 162, conveniently of a springy, substantially rigid plastic material. The clips 162 are of inverted U-shape, with one leg 163 fixed by any convenient means to the cabinet, here by bolting of a flange 164 thereof to a corresponding flange 166 of the cabinet top wall 14C. The free leg 167 of the clip has an inwardly extending ledge 168. Inserting the reinforcing member 143C upwardly into the clip 162 springs apart the clip legs 163 and 167. As the reinforcing member 143C moves up past the ledge 168, the free leg 167 springs back to locate the ledge 168 under the adjacent edge of the reinforcing member 143C and support the strip curtain 81C.

Although the strips comprising the strip curtain may be of simple rectangular cross section, as provided by simply cutting the strips from a sheet of plastic material, the strips may instead be provided with smoothly rounded vertical edges, as for example by bending over the edge portions 171 of strip 86D in FIG. 12, by constructing the strip 86E as a flattened tubular cross section having layers 172 and 173 connected by rounded fold edges 174 in FIG. 13, by enlargement of the strip thickness at the edges 176 of the strip 86F in FIG. 14.

FIG. 15 discloses a still further type of conventional refrigerated food cabinet 10D of the kind in which the top portion 31D of the cabinet front wall is offset substantially to the rear of the bottom portion 32D of the cabinet front wall. Cabinets of this type are often equipped with suitably inclined air curtains 35D. Applicant has found that losses of cold air from such cabinet can be reduced by suspension of a strip curtain 81D (for example similar to strip curtain 81B of FIG. 10) from a horizontal beam 171 cantilevered by several spaced brackets 172 fixed to and extending forwardly from the upper portion 31D of the cabinet frontwall adjacent the cabinet top wall 14D. The beam 171 runs the length of the cabinet 10D. The brackets 172 rigidly support the beam 171 in a position to locate the lower edge of strip curtain 81D just above the top edge 91D of the lower cabinet front wall 32D ahead of the air return grill 43D.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a display-type, refrigerated food cabinet having an access opening communicating with the atmosphere, curtain structure for substantially covering said access opening, comprising:

a first curtain comprising a flexible sheet having first and second spaced and substantially parallel edges, said sheet being prestressed to roll up on itself around an axis substantially parallel with said first edge, said sheet being self-supporting in a tightly rolled position when suspended from said first edge thereof;

means for attaching said first edge of said sheet to said cabinet along and substantially parallel to one edge of said access opening, said sheet in its rolled position being confined near said one edge of said access opening to permit free access to the inside of said cabinet through said access opening, the distance between said first and second edges of said sheet when unrolled being sufficient for covering said access opening from said one edge to the other edge of said access opening to obstruct air movement between the inside and outside of said cabinet;

engaging means for releasably locating said second edge of said sheet near the other edge of said access opening in said covering position of said sheet;

a second curtain comprising a plurality of side-by-side elongate strips of flexible transparent sheet material, said strips being fixed together at their upper ends but not their lower ends;

means for attaching the upper ends of said strips to said cabinet and extending along and substantially parallel to the upper edge of said access opening with said strips depending across said access opening, the depending portions of said strips being laterally displaceable one from another for permitting physical access to the inside of said cabinet, said strips when undisturbed covering said access opening from the top substantially to the bottom thereof to obstruct air movement between the inside and outside of the cabinet while permitting visual inspection therethrough of the inside of the cabinet, said first and second curtains in their closed positions being spaced one in front of the other across said access opening with an air layer therebetween to act as a thermal barrier across said access opening.

2. The apparatus of claim 1, in which said strips are spaced outboard of said flexible sheet, said strips depending substantially along the frontal plane of said cabinet, said sheet being mounted within said cabinet to extend in a plane behind said frontal plane.

3. The apparatus of claim 1, in which said flexible sheet is mounted adjacent the front wall of said cabinet, said sheet in its rolled position lying outside the refrigerated area of the cabinet, said sheet in its extended position lying substantially in the frontal plane of said cabinet, said strips depending in a plane spaced inboard of said frontal plane and from the extended position of said sheet.

4. In a display-type refrigerated food cabinet having an access opening communicating with the atmosphere, and including:

a barrier supported for movement on said cabinet to an open position from a closed position substantially obstructing said access opening and substantially preventing air movement therethrough between the inside and outside of said cabinet, wherein the improvement comprises:

a curtain comprising a plurality of side-by-side elongate strips of flexible transparent sheet material, the upper ends of said strips being fixed together and the lower ends of said strips being free to move with respect to each other;

means for attaching the upper ends of said strips to said cabinet along and substantially parallel to the upper edge of said access opening with said strips depending down across said access opening spaced from said barrier, the lower portions of said strips being laterally displaceable one from another for permitting physical access to the inside of said cabinet when said barrier is open, the lower ends of said strips being spaced above the bottom edge of said access opening by a narrow horizontally extending slot.

5. The apparatus of claim 4, in which said curtain comprises an integral sheet of said flexible transparent material, said sheet having a continuous upper edge portion extending the full width of said sheet, said sheet having vertical slits extending from said upper edge portion down through the bottom of said sheet, so that the lower ends of said strips are free of connection to each other, and interengageable means on said upper end portion of said curtain and on said cabinet above said access opening and comprising said means for attaching the upper ends of said strips to said cabinet.

6. The apparatus of claim 5, in which said upper edge portion is folded over upon itself above said slits and including an adhesive material sandwiched between the folded-over parts of said upper edge portion to fixedly secure same to each other.

7. The apparatus of claim 5, in which said interengageable means comprise a plurality of grommets fixed and extending along said upper edge portion of said sheet and correspondingly spaced hooks distributed along the front of said cabinet above said access opening and engageable with said grommets.

8. The apparatus of claim 5, including an enlarged circular hole at the upper end of each of said slits in said sheet to prevent tearing of said sheet at the upper ends of said slits.

9. The apparatus of claim 4, in which the side-by-side upper ends of said strips are fixed together by sandwiching between a pair of adhesive layers, in turn sandwiched between semi-rigid strips extending horizontally the width of said curtain, said horizontal strips maintaining the side-by-side relation of the upper ends of said strips and serving to support said curtain pendently therefrom, said means for attaching being secured to said curtain and said horizontal strips.

10. The apparatus of claim 9, in which one of said horizontal strips is substantially L-shaped and includes a flange at the upper end thereof extending past the upper edges of said transparent strips and against which same can abut.

11. The apparatus of claim 4, in which said attaching means comprise a plurality of interengageable snap members distributed in spaced relation along the length of the upper end of said curtain and along the cabinet above said access opening for snap-fit securement of the upper edge of said curtain to said cabinet.

12. The apparatus of claim 4, in which said means for attaching comprises a horizontally elongate folded metal reinforcing member, the transparent sheet material at the top of said strips being snugly sandwiched between two layers of said folded reinforcing member and including an adhesive layer interposed in the sandwich between opposed faces of the sheet material and a said layer of said reinforcing member so as to provide a substantially rigid header extending along the top edge portion of said curtain for securing same to said cabinet.

13. The apparatus of claim 4, in which said means for attaching comprises a reinforcing member extending horizontally along the top of said curtain and including a layer facing at least one side of said sheet material, said layer having a lower edge disposed beside said sheet material and facing downward along one side of said strip curtain, said means for attaching including an inverted U-shaped bracket constructed of springy material, one leg of said bracket being attached to said cabinet, the other leg of said bracket being bendable away from said first leg and having a ledge adjacent its bottom edge extending toward the first-mentioned leg, the depth of said U-shape somewhat exceeding the height of said reinforcing member for receiving same upwardly into said inverted U-shaped bracket by springing apart of the legs thereof, said ledge of said bracket facing upward to abut the lower edge of said reinforcing member, whereby said bracket receives said reinforcing member in snap-fit relation therein for supporting said strip curtain on said cabinet.

14. The apparatus of claim 4, in which the adjacent vertical edges of said transparent strips are of thickness greater than said sheet material and are smoothly rounded to prevent snagging of the strips on articles moved into and out of the cabinet.

15. In a refrigerator of the kind having an openfront cabinet, said cabinet having upper and lower front wall portions extending the width of the cabinet and respectively bounding the top and bottom of an access opening into the cabinet, said upper and lower front wall portions substantially sharing a common plane;

air curtain means for providing a refrigerated stream of air crossing said access opening in spaced relation behind said common plane, said air curtain means including an air outlet slot in said cabinet behind said upper front wall portion and an air return slot in said cabinet behind said lower front wall portion, said slots extending the width of said cabinet for providing a substantially planar downwardly moving curtain of air spaced behind the front wall of said cabinet;

the improvement comprising:

a strip curtain fixed with respect to said upper front wall portion of said cabinet and depending therefrom into close spaced relation to the upper edge of said lower front wall portion of said cabinet, said strip curtain comprising a plurality of side-by-side elongated strips of flexible transparent sheet material, said strips being fixed together at the upper ends thereof but not at the lower ends thereof;

means for attaching the upper ends of said strips to said cabinet and extending substantially parallel to the upper edge of the access opening of said cabinet, with said strips depending across said access opening, the depending portions of the strips being laterally displaceable one from another for permitting physical access to the inside of said cabinet, said strips when undisturbed covering said access opening from the top thereof substantially to the bottom thereof to obstruct air movement between the inside and outside of the cabinet while permitting visual inspection therethrough of the inside of the cabinet, said strip curtain being spaced forwardly from said air curtain means, the lower ends of said strips being spaced above the upper edge of said lower front wall portion by a vertically narrow space extending widthwise of said access opening, the lower ends of said strips lying adjacent the front edge of said air return slot of said air curtain means, the space being provided so as to prevent the lower ends of the strips from being displaced or sucked into the air return grill and to permit a modest flow of air through the gap between the strip ends and cabinet edge wall.

16. The apparatus of claim 15, including a flexible sheet curtain interposed in spaced relation between said air curtain means and said strip curtain, said flexible sheet curtain being fixed at one edge to said cabinet and being storable adjacent one edge of said access opening to leave said cabinet open to access thereinto through said strip curtain and air curtain means, said flexible sheet curtain being extendible across said access opening near at least one of said strip curtain and said air curtain means to the opposite wall of said cabinet to form an air layer-type thermal barrier between said flexible sheet and strips when access to said access opening is not required.

17. The apparatus of claim 15, in which said upper front wall portion of said cabinet is offset to the rear of said lower front wall portion, said means for attaching including brackets extending forwardly from said cabinet in the region of said upper front wall portion and a substantially horizontal beam carried by said brackets in spaced relation ahead of said upper front wall portion of said cabinet, said beam overlying the lower front wall portion of said cabinet in a vertical plane in front of said air return slot of said air curtain means, said strip curtain depending from said beam.

* * * * *